US007526928B1

(12) United States Patent
Kearnes et al.

(10) Patent No.: US 7,526,928 B1
(45) Date of Patent: May 5, 2009

(54) MULTI-COLOR GEMSTONES AND GEMSTONE COATING DEPOSITION TECHNOLOGY

(75) Inventors: Ronald H. Kearnes, Rochester, MN (US); Debbie Kearnes, Rochester, MN (US); Steven F. Starcke, Rochester, MN (US)

(73) Assignee: Azotic Coating Technology, Inc., Rochester, MN (US)

( * ) Notice: Subject to any disclaimer, the term of this patent is extended or adjusted under 35 U.S.C. 154(b) by 277 days.

(21) Appl. No.: 11/303,464

(22) Filed: Dec. 17, 2005

Related U.S. Application Data

(63) Continuation-in-part of application No. 10/288,401, filed on Nov. 4, 2002, now Pat. No. 6,997,014.

(51) Int. Cl.
*A44C 17/00* (2006.01)

(52) U.S. Cl. ..... 63/32

(58) Field of Classification Search ..... None
See application file for complete search history.

(56) References Cited

U.S. PATENT DOCUMENTS

| | | | | |
|---|---|---|---|---|
| 2,430,452 | A | 11/1947 | Colbert | 359/584 |
| 2,466,119 | A | 4/1949 | Moulton | 359/580 |
| 2,478,817 | A | 8/1949 | Gaiser | |
| 2,519,547 | A | 8/1950 | Colbert | 359/584 |
| 2,535,807 | A | 12/1950 | Moyd | 63/32 |
| 2,587,972 | A | 3/1952 | Crise | 63/32 |
| 2,690,630 | A | 10/1954 | Eversole | 427/215 |
| 2,901,379 | A | 8/1959 | Shannon | 428/334 |
| 2,948,082 | A | 8/1960 | Watson | 49/78.1 |
| 3,011,383 | A | 12/1961 | Sylvester | |
| 3,039,280 | A | 6/1962 | Flad | 63/32 |
| 3,306,768 | A | 2/1967 | Peterson | 427/255 |
| 3,412,575 | A | 11/1968 | Feldman | |
| 3,468,646 | A | 9/1969 | Finn | 65/30.1 |
| 3,490,250 | A | 1/1970 | Jones | 63/32 |
| 3,508,894 | A | 4/1970 | Torok | 65/30.1 |
| 3,514,320 | A | 5/1970 | Vaughan | 117/109 |

(Continued)

FOREIGN PATENT DOCUMENTS

| | | |
|---|---|---|
| EP | 0 248 525 | 9/1987 |

(Continued)

OTHER PUBLICATIONS

Hadley, Wayne Aqua Aura: "A Revolutionary Enhancing Process Turns Quartz into a Rainbow" *Rock and Gem* (May 1989).

(Continued)

*Primary Examiner*—Jack W. Lavinder
(74) *Attorney, Agent, or Firm*—Fredrikson & Byron, PA

(57) ABSTRACT

The invention provides a gemstone or a decorative object having at least one surface bearing a thin film coating. In some embodiments, there is provided a gemstone having an appearance characterized by at least two different color zones, where such two zones are of different colors. In other embodiments, two different areas of a single (e.g., integral, one-piece) gemstone carry coatings of different composition, and the resulting appearance of the gemstone is characterized by the stone exhibiting substantially a single uniform body color that is different than the body color the stone would exhibit if it were coated only with one or the other of the coatings. Also provided are new deposition techniques.

26 Claims, 5 Drawing Sheets

U.S. PATENT DOCUMENTS

| | | | | |
|---|---|---|---|---|
| 3,539,379 | A | 11/1970 | Mayer | 427/255.19 |
| 3,552,352 | A | 1/1971 | McConnel | 118/720 |
| 3,665,729 | A | 5/1972 | Elbe | 63/32 |
| 3,711,322 | A | 1/1973 | Kushihashi | 428/336 |
| 3,837,884 | A | 9/1974 | Rheinberger | 427/596 |
| 3,848,876 | A | 11/1974 | Joschko | 369/173 |
| 3,897,529 | A | 7/1975 | Carr | 501/86 |
| 3,650,596 | A | 4/1976 | Carr | 428/700 |
| 3,950,596 | A | 4/1976 | Carr | |
| 4,030,317 | A | 6/1977 | Rogell | 63/32 |
| 4,039,726 | A | 8/1977 | Carr et al. | 428/539 |
| 4,353,765 | A | 10/1982 | Covi | 156/212 |
| 4,425,769 | A | 1/1984 | Hakoune | 63/32 |
| 4,490,440 | A | 12/1984 | Reber | 428/620 |
| 4,604,876 | A | 8/1986 | Hoffmann | 63/32 |
| 4,705,356 | A | 11/1987 | Berning | |
| 4,735,869 | A | 4/1988 | Morita | |
| 4,779,898 | A | 10/1988 | Berning | 283/58 |
| 4,793,864 | A | 12/1988 | Neumiller et al. | 134/1 |
| 4,797,308 | A | 1/1989 | Mattin | 428/15 |
| 4,809,417 | A | 3/1989 | Normann | 29/896 |
| 4,835,023 | A | 5/1989 | Taniguchi | 428/15 |
| 4,942,744 | A | 7/1990 | Wei | 63/26 |
| 5,054,902 | A | 10/1991 | King | 351/44 |
| 5,080,455 | A | 1/1992 | King | 359/350 |
| 5,235,462 | A | 8/1993 | Bidermann | 359/580 |
| 5,427,826 | A | 6/1995 | Iida | 427/575 |
| 5,605,759 | A | 2/1997 | Prince | 428/408 |
| 5,853,826 | A | 12/1998 | Starcke et al. | 428/15 |
| 5,879,775 | A | 3/1999 | Walter | 428/76 |
| 5,882,786 | A | 3/1999 | Nassau | 428/336 |
| 5,888,918 | A | 3/1999 | Pollak | 501/86 |
| 5,952,084 | A | 9/1999 | Anderson | |
| 6,000,240 | A | 12/1999 | Noda | 63/26 |
| 6,146,723 | A | 11/2000 | Arends | 428/15 |
| 6,197,428 | B1 | 3/2001 | Rogers | 428/446 |
| 6,376,031 | B1 | 4/2002 | Pollak | 428/15 |
| 6,794,014 | B2 | 9/2004 | Winter | 428/156 |
| 6,872,422 | B2 | 3/2005 | Gupta | 427/255 |
| 6,997,014 | B2 | 2/2006 | Starcke | |
| 7,033,640 | B2 | 4/2006 | Rauch | 427/229 |
| 7,137,275 | B2 | 11/2006 | Starcke | |
| 2003/0008077 | A1 | 1/2003 | Gupta | 427/376.2 |
| 2003/0224167 | A1 | 12/2003 | Wright | 428/408 |
| 2004/0231158 | A1 | 11/2004 | Altenberger | 29/896.41 |
| 2006/0068106 | A1 | 3/2006 | Starcke | 427/248 |
| 2006/0182883 | A1 | 8/2006 | Neogi | 427/240 |

FOREIGN PATENT DOCUMENTS

| | | |
|---|---|---|
| JP | 63-049704 | 3/1988 |
| JP | 06-250016 | 9/1994 |

OTHER PUBLICATIONS

McKnight, William "Record and Disclosure of Invention for Supernatural Conductive Quartz" (Mar. 3, 1998).

Kurt Nassau, "The Origins of Color in Minerals" from American Minerologist, vol. 63, pp. 219-229, 1978.

"Press and Publicity" from the home page of Tavalite Enterprises of Sonoma, date unknown (four pages). Portions reprinted from AJM Magazine, Jul. 1999; Professional Jeweler, Aug. 1998; Gems and Gemology, Summer 1996; Jeweler's Circular Keystone, May 1997; Home Business Magazine, Oct. 2000.

"About Us" from the home page of Tavalite Enterprises of Sonoma, date unknown (three pages).

"Contact Us" from the home page of Tavalite Enterprises of Sonoma, date unknown (one page).

Reflectivity of Thin Films, H.H. Roseberry and P.L. Schmidt (Ohio University 1942), 4 pages.

English language abstract for JP 06-250016.

English language abstract for JP 63-049704.

MULTI-COLOR GEMSTONES AND GEMSTONE COATING DEPOSITION TECHNOLOGY

CROSS REFERENCE TO RELATED APPLICATIONS

The present application is a continuation-in-part of U.S. patent application Ser. No. 10/288,401, filed Nov. 4, 2002 now U.S. Pat. No. 6,997,014, the teachings of which are incorporated herein by reference.

FIELD OF THE INVENTION

The invention provides coatings for gemstones. More particularly, this invention provides coatings that impart desirable color in gemstones. The invention also provides methods for producing (e.g., depositing) thin film coatings of various types.

BACKGROUND OF THE INVENTION

The invention relates to altering the appearance of decorative objects, such as gemstones, by coating the decorative objects with thin film coatings that provide color to improve the appearance of the objects.

A number of processes have been developed to improve the appearance of gemstones or to create simulated gemstones. For example, methods of diffusing ions into gemstones (e.g., diffusing ions of titanium and/or iron into sapphire, or diffusing ions of cobalt into topaz) have been disclosed. These diffusion methods, however, traditionally have been limited to specific ions and specific substrates. Moreover, diffusion methods typically involve extremely high temperature, which frequently causes breakage or damage of the gemstones. Diffusion methods characteristically cause the added ions to become part of the crystal surface with no distinct boundary. In fact, diffusion methods commonly leave a gradient of ion concentration in the substrate (e.g., in a gemstone). Diffusion methods typically require long processing times, commonly more than a day. Reference is made to U.S. Pat. Nos. 2,690,630 and 4,039,726.

Nuclear radiation has been used to produce color centers in gemstones, giving a body color that in some cases can be improved with heat treatment. Cyclotrons and neutron bombardment are routinely used to impart blue color in colorless topaz. This method does not involve coating the stone. Rather, it produces color centers throughout the stone. A disadvantage of this method is the requirement for a "cooling off" period to allow the topaz to radioactively decay to a safe level. Traditionally, it has only been possible to obtain shades of blue with this method. Impurities in the gemstone (and the nuclear process used) determine the particular shade of blue that is obtained. Thus, it is difficult to obtain a consistent color on any given lot of gemstones.

Rhinestones and Carnival Glass have reflective coatings layered on one or more surfaces of a clear substrate. The coating is usually silver or some other highly reflective material utilized to apply a mirror coating (usually silver or aluminum) onto the back (e.g., the pavilion) of a faceted glass gem. In such a coating, substantially all of the light is reflected without passing through the coating. U.S. Pat. No. 3,039,280 is representative.

Commonly-assigned U.S. Pat. No. 5,853,826, issued to Starcke et al., discloses desirable coatings for enhancing the optical properties of a decorative object, such as a gemstone. The coatings impart in the decorative object a desirable colored appearance, wherein the color of light reflected from the decorative object to a viewer changes with angle of observation.

Tavelite™ is a product produced by depositing thin multiple layers on a transparent substrate to produce an interference effect. The coating is believed to be deposited, at least in some cases, through a process that involves high temperatures. When gemstones are coated at high temperatures, considerable breakage can occur.

U.S. Pat. No. 6,197,428, issued to Rogers, assigned to Deposition Sciences, Inc., is believed to disclose the coatings and deposition methods that are used for some of the Tavelite™ products. The Rogers patent teaches an optical interference coating that is applied over the entire surface of a gemstone. The coating comprises alternating layers of materials with relatively high and low refractive indices. The coating is said to be composed of materials that are substantially free of absorption of light (i.e., visible radiation). In particular, the optical interference coating is said to impart in the coated gemstone perceived color that is dependent on the angle of incidence and the relative positions of the object and the viewer.

Layered coatings on a surface of a gemstone have been provided to increase the "fire" of the stone. These techniques involve a first coating of a highly refractive material, with respect to the gemstone's index of refraction, followed by a second coating of a different highly refractive material. The layers are designed so that the light reflected at each interface of each layer causes an optical interference effect. Coatings of this nature are described, for example, in U.S. Pat. No. 3,490,250.

Aqua-Aura™, a product of Vision Industries, is a surface treatment providing a single moderately saturated color. The surface treatment is proprietary, but is believed to involve a gold-based coating that is deposited by spraying at high temperatures.

Atmospheric pressure chemical vapor deposition has been used to deposit films of titanium oxide by thermal decomposition of a titanium compound (usually $TiCl_4$) in air.

Colored lacquers have been painted onto the pavilion of gemstones to give the stones a colored appearance. Unfortunately, these lacquers tend to have poor durability, and have been found to come off easily.

Gemstones are prized for their beauty, rarity, and durability. Valuable gems may be composed of natural or synthetic materials or a combination of the two. The color and appearance of a gemstone may be improved by a color treatment process. Both natural and synthetic gem material can be treated. Examples of color treatments include heat, nuclear radiation, x-ray, thermal diffusion of a colorant ion, thin film coating, and the like (examples discussed above).

Natural sapphire (also discussed above) is often treated with high heat in a controlled atmosphere to yield beautiful blue or yellow colors. Titanium and/or iron impurity ions interact with the heat and atmosphere of a reducing or oxidizing nature producing color. Natural topaz may be artificially colored blue with nuclear radiation. Alternatively, it may be heat treated, thermally ion diffused, or surface coated with thin film layers.

Certain rare natural gemstones have two or more colors. Different regions of the uncut crystal have different colors due to the conditions of its formation. The resulting multicolored crystal may be carefully oriented during cutting to display these colors to good effect. For example: amethyst-citrine is a combination of purple (amethyst) and yellow (citrine) quartz. Watermelon tourmaline has green, white, and red color zones on a single crystal. These natural gemstones are very beautiful but quite rare and difficult to cut.

Multi-color gems may also be synthesized by changing dopant ion concentration during crystal growth. Gem materials of differing colors may also be bonded together in various ways with adhesive prior to cutting. Careful orientation of the glued rough material is required for best results.

It would be desirable to provide a multi-colored gemstone by selective area coating of natural or synthetic gems, such as a gemstone that displays a pleasing appearance resembling rare gemstones with two or more colors. It would also be desirable to provide new thin film deposition methods that can be used to apply multi-colored coatings to gemstones and/or to apply other types of coatings.

SUMMARY OF THE INVENTION

Figure 1:
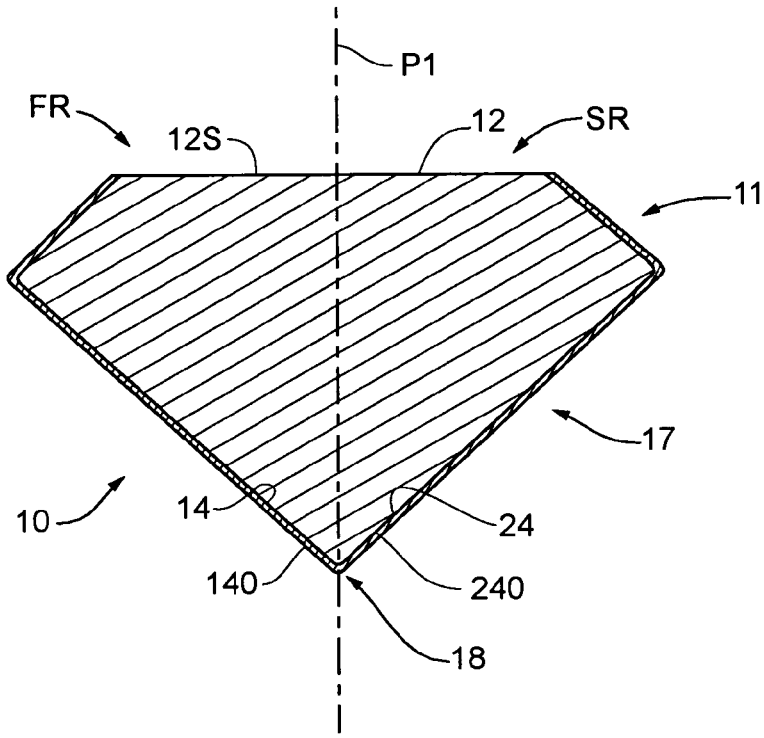
FIG. 1 is a cross-sectional side view of a color-enhanced gemstone in accordance with certain embodiments of the invention.

In certain embodiments, the invention provides a method for color enhancing a gemstone. In the present embodiments, the method comprises applying a first coating to a first area of the gemstone and applying a second coating to a second area of the gemstone. Preferably, the first and second coatings are off different composition. In more detail, the first coating preferably is adapted to impart a first color if applied alone to the gemstone, and the second coating preferably is adapted to impart a second color if applied alone to the gemstone. In the present method, the first and second areas of the gemstone are both maintained in an unmasked condition during the application of the first coating as well as during the application of the second coating.

In certain embodiments, the invention provides a gemstone having a table and a pavilion, wherein a first coating is on a first area of the pavilion and a second coating is on a second area of the pavilion. In some of the present embodiments, the first and second coatings are of different composition. Preferably, the table defines an uncoated surface in the present embodiments.

In certain embodiments, the invention provides a gemstone having a table and a pavilion, wherein a first coating is on a first area of the pavilion and a second coating is on a second area of the pavilion. In the present embodiments, the first and second coatings preferably are of different composition. For example, in some of the present embodiments, the first coating comprises a first material selected from the group consisting of platinum, copper, silver, gold, silicon, and bismuth, and the second coating comprises a second material selected from the group consisting of chromium, niobium, tantalum, zirconium, titanium, and stainless steel.

DETAILED DESCRIPTION OF PREFERRED EMBODIMENTS

The following detailed description is to be read with reference to the drawings, in which like elements in different drawings have like reference numerals. The drawings, which are not necessarily to scale, depict selected embodiments and are not intended to limit the scope of the invention. Skilled artisans will recognize that the examples provided herein have many useful alternatives that fall within the scope of the invention.

The invention relates to enhancing the appearance of gemstones and other decorative objects. The substrate can be formed of materials that are found naturally in the earth, or from synthetic materials (man-made materials, such as are made in a lab). The methods of the invention enhance the color and brilliance of decorative objects, such as faceted or cabochon cut stones, by the application of coatings having desirable color-enhancement properties. In some (though, not all) embodiments, coatings are applied to the back (e.g., the pavilion) of a gemstone, optionally only to the back of the gem, or substantially only to the back of the gem.

Various materials have inherent color and reflectivity/transmissivity properties that do not lend themselves well for use as decorative objects. Examples include such low cost transparent gem materials as colorless quartz ($SiO_2$), topaz ($AL_2SiO_4F_2$), and beryl ($AL_2Be_2Si_6O_{18}$). To enhance the decorative properties of such gem materials, pigments and dyes (colorant) have been used to provide colors in stones having cracks into which the colorant is made to penetrate. The colorant imparts a color change in the base gem material.

The present invention teaches techniques that apply thin (generally less than about 50,000 Å, and preferably less than about 15,000 Å) coatings. In some (though, not all) embodiments, the coatings do not materially change the dimensions, structure, or composition of the underlying substrate. The coatings provide improved coloration pleasing to the naked eye of a human observer.

In some embodiments, the decorative object is a gemstone selected from the group consisting of topaz, quartz, beryl, and cubic zirconia. In one subgroup of these embodiments, the gem is selected from the group consisting of topaz, quartz, and beryl.

Certain embodiments of the invention provide a color-enhanced gemstone (natural or synthetic) that exhibits multiple colors by virtue of designated areas being coated selectively with different colors. The different colored areas of the stone may be coated sequentially or simultaneously. Each coating applied may be of uniform color, dichroic color, or a combination of both. The coated gemstone in these embodiments displays a pleasing appearance, which can optionally resemble rare gemstones having two or more colors (i.e., exhibiting two or more colors when such a gemstone is viewed at one static angle of observation).

Thus, in certain embodiments, different color zones are produced on a gemstone by selective area coating of the stone. For example, by precision spraying a first coating on a first area of the stone and precision spraying a second coating on a second area of the stone while maintaining both the first and second areas in an unmasked condition, the manufacturer can avoid the extensive labor and long run times associated with having to carefully mask and unmask the appropriate areas of each individual stone. It will be appreciated that gemstones are commonly produced in large batches, so that having to mask and unmask the tiny areas on every single stone would be an extraordinarily burdensome task. Moreover, the time required to complete a production run would be unduly long, and it likely would be impossible to turn out product at an acceptable rate.

Preferably, the invention provides a decorative object (e.g., a glass object, cut gemstone or natural crystal structure, such as a mineral) having at least two surface areas that are coated to give the decorative object an improved appearance. While the decorative object is a gemstone in some cases, the properties (e.g., color) of many transparent or translucent substrates can be altered in accordance with the invention.

One group of embodiments provides a gemstone 10 having a table 12 and a pavilion 17. Exemplary gemstones 10 of this nature are perhaps best appreciated with reference to FIGS. 1-4. In the present group of embodiments, a first coating 140 is on a first area 14 of the gemstone 10 (e.g., of the pavilion 17) and a second coating 240 is on a second area 24 of the gemstone (e.g., of the pavilion). The first 14 and second 24 areas of the gemstone 10 can optionally be contiguous, as shown in FIG. 1. Preferably, the first 140 and second 240 coatings are of different composition (i.e., from each other). For example, these two coatings may have layers of different chemical composition, layers of different thickness, different numbers of layers, different arrangements of layers, etc. In some embodiments, the first coating 140 comprises a desired chemical element (and/or a layer of a desired film material) not found in the second coating 240. Additionally or alternatively, the first coating 140 can have a different thickness than the second coating 240 (optionally, these thicknesses can vary by at least about 10 Å, at least about 25 Å, at least about 50, or at least about 100 Å). Still further, the first coating 140 can have a different number of layers than the second coating 240. In the present group of embodiments, the first coating 140 can optionally be adapted to impart a first color in the gemstone 10 (e.g., if applied alone to the gemstone) and the second coating 240 can optionally be adapted to impart a second color in the gemstone (e.g., if applied alone to the gemstone). In such cases, if the first coating 140 alone were applied so as to cover the whole pavilion 17 of a gemstone 10 (but not the crown), then the gemstone would have a different colored appearance than if the second coating 240 alone were applied so as to cover the whole pavilion of the gemstone (but not the crown).

In the present embodiments, the table 12 preferably defines an uncoated surface 12S. This is perhaps best seen with reference to the exemplary gemstone of FIG. 1. The uncoated surface 12S can encompass the entire surface area of the table, or it can encompass only part of the table's surface area. In some embodiments, the table 12 of the gemstone 10 is entirely or substantially entirely uncoated. For example, some coating overspray may be found on a table that is otherwise uncoated, and for purposes of this particular disclosure, such a table may be considered to be substantially entirely uncoated.

In some embodiments of the present group, the gemstone has two (or more) different regions that exhibit different colors. For example, in some cases, the first coating 140 on the first area 14 imparts a first color in a first region FR of the gemstone, and the second coating 240 on the second area 24 imparts a second color in a second region SR of the gemstone. In other cases, the optical effect of the two different coatings 140, 240 is such that the gem exhibits substantially a single color (e.g., when viewed at one static angle and/or when viewed at different angles) that is different than the color the stone would exhibit if it were coated only with one or the other of the coatings 140, 240.

Figure 4:
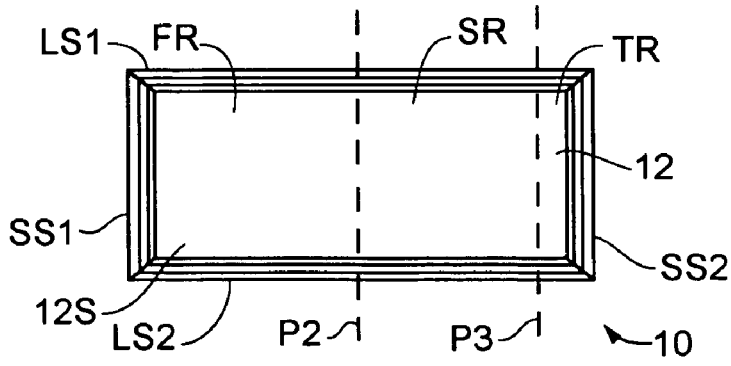
FIG. 4 is a top view of a color-enhanced gemstone in accordance with certain embodiments of the invention.

FIG. 4 exemplifies one particular group of embodiments wherein a special optical effect is achieved. Here, the first coating on the first area imparts a dominant color in a first region FR of the gemstone 10, and the second coating on the second area imparts a non-dominant color in a second region SR of the gemstone. The special optical effect achieved in the present embodiments is characterized by the gemstone having a third region TR that exhibits either the dominant color or a mixture of the dominant and non-dominant colors. In FIG. 4, the second region SR of the gemstone 10 is shown as being located between the first FR and third TR regions of the gemstone. This is the case, for example, in certain embodiments wherein the gemstone has a cross-sectional configuration that is at least generally rectangular (such as a baguette-cut gemstone). This optical effect, however, is by no means required in all embodiments of the invention.

Figure 3:
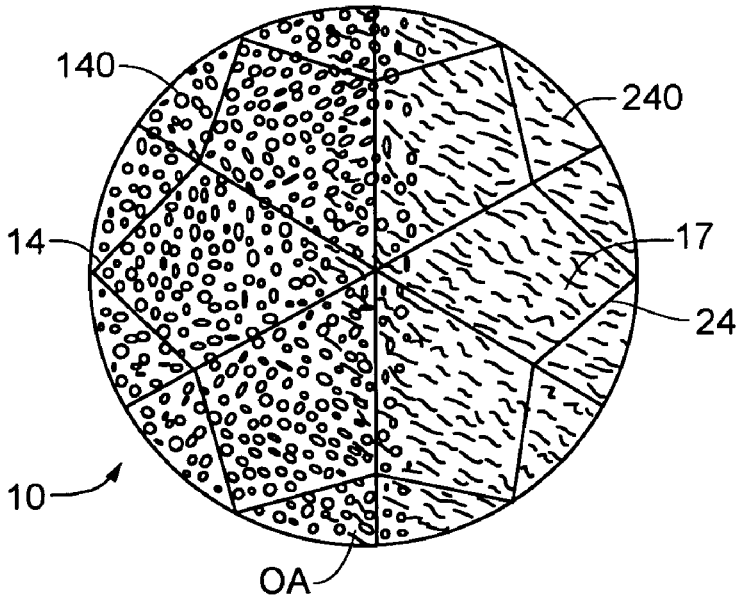
FIG. 3 is a bottom view of a color-enhanced gemstone in accordance with certain embodiments of the invention.

Turning now to FIG. 3, there is shown a gemstone 10 on which two coatings 140, 240 have been applied so as to overlap or intermix to some extent. In FIG. 3, the pavilion 17 of the illustrated gemstone 10 has an overlap area OA characterized by an overlap and/or a mixture of both the first 140 and second 240 coatings. On opposite sides of the illustrated overlap area, there are areas respectively carrying substantially only the first coating 140 and substantially only the second coating 240. An overlap region OA may result, for example, when the gemstone 10 is coated by a non-masking deposition method. Non-masking deposition methods will commonly be preferred. Many embodiments (e.g., product embodiments) of this invention, however, are not so limited. For example, a coated gem having the features specified for a basic product embodiment can alternatively be produced using a method that involves masking.

In certain embodiments, the noted first 14 and second 24 areas (which can optionally both be areas of a pavilion 17 of the gemstone) are located primarily on opposite sides of a plane P1 that is at least generally perpendicular to the table 12 of the gemstone 10. This is perhaps best appreciated with reference to FIG. 1, which depicts an embodiment wherein the first 14 and second 24 areas are on opposite sides of a plane P1 (which optionally passes through a culet 18 of the gemstone) perpendicular to the gemstone's table 12.

Figure 5:
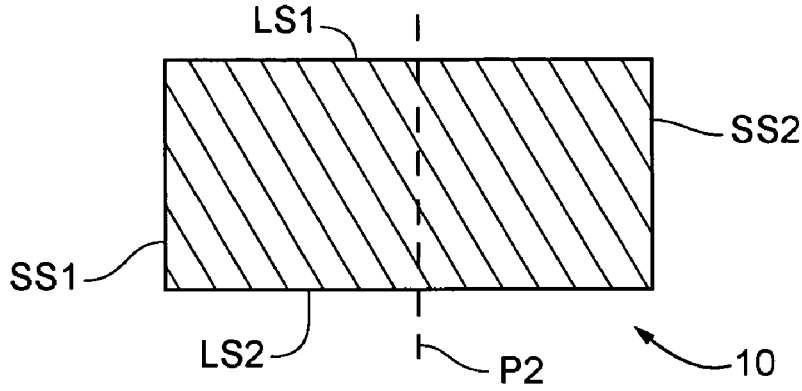
FIG. 5 is a cross-sectional top view of a color-enhanced gemstone in accordance with certain embodiments of the invention.
Figure 6:
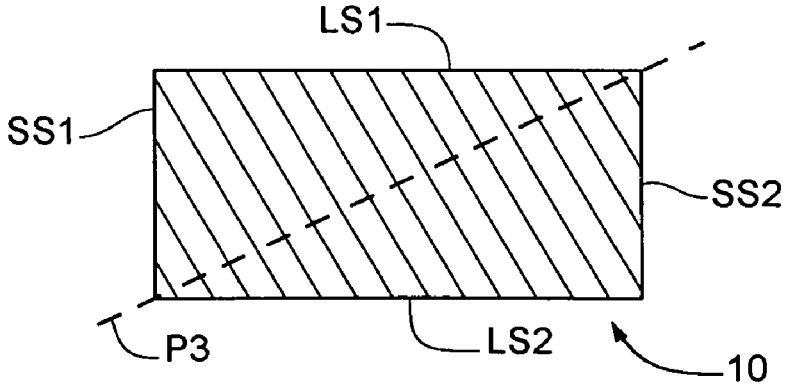
FIG. 6 is a cross-sectional top view of a color-enhanced gemstone in accordance with certain embodiments of the invention.

As noted above, some embodiments provide a gemstone 10 having a cross section that is at least generally (or at least substantially) rectangular. FIGS. 4-6 exemplify gemstones of this nature. Here, each illustrated gemstone has a cross section (e.g., taken along a plane parallel to the table 12) that is rectangular. In FIGS. 5 and 6, the cross section is shown as having two long sides LS1, LS2 that are at least generally parallel to each other. In the embodiment of FIG. 5, it will be appreciated that the noted first and second areas of the gemstone 10 (which areas are optionally on a pavilion of the stone) are located primarily on opposite sides of a plane P2 that is at least generally perpendicular to both of the noted long sides LS1, LS2. The cross section preferably also has two short sides SS1, SS2. In some embodiments of this nature, the first coating 140 on the first area 14 imparts a dominant color in a first region FR of the gemstone, the second coating 240 on the second area 24 imparts a non-dominant color in a second region SR of the gemstone, the gemstone further includes a third region TR that exhibits either the dominant color or a mixture of the dominant and non-dominant colors, and this third region is adjacent to one of the two short sides SS1, SS2 of the noted cross section.

In the embodiment of FIG. 6, the noted first 140 and second 240 areas are located primarily on opposite sides of a plane P3 that extends diagonally across a rectangular cross section of the gemstone. This feature can be provided advantageously to achieve an optical effect where the colors of the two coatings 140, 240 coalesce to give the gemstone the appearance of a single uniform body color that is different than the body color the stone would exhibit if it were coated only with one or the other of the coatings 140, 240.

In some cases, the first 140 and second coatings 240 are discrete coatings on the gemstone 10, such that the gemstone is at least substantially free of material diffused into the gemstone from either of the first and second coatings. Such coatings are commonly applied, and optionally heat treated, under conditions that do not cause coating material to diffuse substantially into the substrate. While this is advantageous in that low-temperature production methods tend to result in breakage, this is not required in all embodiments. For example, a gemstone having the features noted in a basic embodiment could in some cases be the product of a high temperature deposition process and/or a high temperature post-deposition treatment.

The figures depict embodiments wherein each substrate 10 is a gemstone. The invention, however, is not limited to cut gemstones. The illustrated gemstones 10 are multifaceted. These stones can be of any desired cut, such as the well known "brilliant" cut configuration, the well known "step cut" or "Dutch rose cut" configurations, etc. The gem 10 of FIG. 1 has a crown 11 and a pavilion 17. The crown 11 (or "front" or "top") of the gemstone 10 defines a table 12 at its top surface and has a plurality of optional facets. The pavilion 17 (or "back" or "underside") of the gemstone defines an optional culet 18 at its bottom tip and also has a plurality of optional facets. The embodiment of FIG. 1 involves two coatings 140, 240 on the pavilion 17 of the illustrated stone 10.

Figure 2:
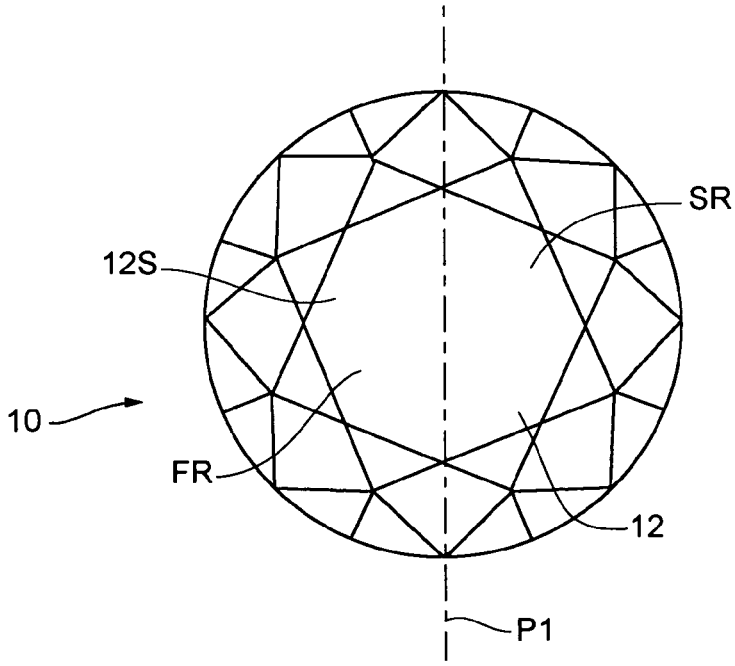
FIG. 2 is a top view of a color-enhanced gemstone in accordance with certain embodiments of the invention.

FIGS. 2 and 3 also depict a gemstone 10 bearing two coatings 140, 240 in accordance with certain embodiments of the invention. Preferably, the total thickness of each coating 140, 240 is very thin. For example, the coating thickness (all thicknesses described herein are physical thicknesses unless specified as being optical thicknesses) is preferably between about 100 Å to about 50,000 Å, and perhaps more preferably between about 100 Å and about 15,000 Å.

One group of embodiments provides particular combinations of materials for the first 140 and second 240 coatings. For example, the first coating 140 can optionally comprise a first material selected from the group consisting of platinum, copper, silver, gold, silicon, and bismuth, while the second coating 240 comprises a second material selected from the group consisting of chromium, niobium, tantalum, zirconium, titanium, and stainless steel. In one embodiment of this nature, the first coating 140 comprises a first material selected from the group consisting of silicon and bismuth, while the second coating 240 comprises a second material selected from the group consisting of chromium, zirconium, and titanium.

One or each of the coatings 140, 240 can optionally comprise film that is highly absorptive of visible radiation (i.e., light). For example, one or each of the coatings 140, 240 can include an absorber layer. The absorber layer, when provided, can comprise any of a variety of high absorption film materials. One embodiment provides an absorber layer comprising (e.g., consisting essentially of) substoichometric titania. A further embodiment provides an absorber layer comprising (e.g., consisting essentially of) superstoichiometric titania.

In certain embodiments, one or each of the coatings 140, 240 includes at least one film layer comprising both a dielectric carrier material and a dopant (or "colorant") that is highly absorptive of visible radiation. Each of the illustrated coatings 140, 240 can optionally consist of a single absorbing layer. When provided, each such layer preferably has a different composition (and a different refractive index) than the substrate 10. If so desired, each such absorbing layer can be deposited directly upon the substrate 10. However, this is by no means required—nor is it required for either coating 140, 240 to comprise an absorber layer.

When incorporated into one or each of the coatings 140, 240, a dielectric carrier material can comprise any desired dielectric material. The term "dielectric" is used herein to refer to any non-metallic (i.e., neither a pure metal nor a metal alloy) compound that includes any one or more metals. Included in this definition would be any metal oxide, metal nitride, metal carbide, metal sulfide, metal boride, etc., and any combination thereof (e.g., an oxynitride). Further, the term "metal" should be understood to include all metals and semi-metals (i.e., metalloids).

When incorporated into one or each coating 140, 240, a colorant preferably comprises material that is highly absorptive of visible radiation. For example, a highly absorptive colorant can optionally comprise a metal selected from the group consisting of chromium, cobalt, cerium, vanadium, praseodymium, manganese, iron, nickel, copper, ruthenium, rhodium, silver, gold, and platinum. Thus, a colorant may be present in the form of a metal or metal alloy. Alternatively, a colorant may be present as an oxide, nitride, boride, or another compound. In one particular embodiment, one or each of the coatings 140, 240 includes an absorber layer comprising (e.g., consisting essentially of) silicon oxide, cobalt oxide, titanium oxide, and cesium oxide. In another embodiment, one or each of the coatings 140, 240 includes an absorber layer comprising (e.g., consisting essentially of) silicon oxide and silver. In still another embodiment, one or each of the coatings 140, 240 includes an absorber layer comprising (e.g., consisting essentially of) titanium oxide and vanadium oxide.

In certain preferred embodiments, one or each of the coatings 140, 240 includes: (1) a dielectric material that is a compound comprising a first metal, and; (2) a colorant comprising a second metal; where the noted first and second metals are different.

Thus, one or each of the coatings 140, 240 can optionally serve as an absorber of certain light frequencies to provide color. Alternatively or additionally, one or each of the coatings 140, 240 can optionally provide color by optical interference. Advantageous coatings of this nature are described in U.S. Pat. No. 5,853,826 (issued to Starcke et al., and assigned to Azotic Coating Technology, Inc.), the teachings of which relating to exemplary optical interference coatings are incorporated herein by reference.

In some embodiments wherein one or each of the coatings 140, 240 provides color by absorption, light entering the top (e.g., the crown, including the table) of the gemstone 10 passes through the absorbing film on the stone. This imparts color in the stone, thereby giving the stone a pleasing appearance and increasing the stone's value.

When provided as part of one or each of the coatings 140, 240, an absorbing layer (or "absorber layer" or "high absorption layer") preferably has an optical thickness of less than about one quarter of a wavelength of visible radiation (i.e., light). Visible radiation occurs in the wavelength range of between about 380 nm and about 780 nm. Thus, such a high absorption layer can optionally have an optical thickness of less than about 950 Å. In certain embodiments, such a high absorption layer has an optical thickness of between about 200 Å and about 950 Å. As is well known in the present art, optical thickness is the product of a film's physical thickness and its refractive index.

In certain preferred embodiments, one or each of the coatings 140, 240 includes a high absorption layer applied directly to the substrate 10. It will be understood, however, that the invention provides alternate embodiments wherein one or more films are positioned between the substrate 10 and each such a high absorption layer. In some embodiments, each of the coatings 140, 240 consists of a single film layer. In other embodiments, each of the coatings 140, 240 consists of two layers, although one or more films can optionally be positioned between such two layers. In certain embodiments, one or each of the coatings 140, 240 comprises more than 20 layers, more than 50 layers, or even more than 100 layers of film. Thus, in embodiments where an absorber layer is applied directly to the substrate 10, it can be appreciated that one or more films can be provided over the absorber layer (which in such embodiments may be applied directly to the substrate or over one or more films. Regardless of their particular layer structures, the coatings 140, 240 impart in the decorative object 10 desirable color.

In some embodiments, the color of the coated gemstone is (i.e., appears) substantially constant or "solid" (i.e., does not substantially change in hue) at different angles of observation (i.e., at different viewing angles/when moving the decorative object relative to the observer or visa versa). That is, the gemstone has a single uniform body color in such embodiments. Thus, one aspect of the invention provides a decorative object bearing coatings 140, 240 that impart (through absorption of visible radiation passing through the coatings) in the decorative object a solid body color that appears substantially constant at different angles of observation, such that the coated decorative object has a substantially non-dichroic appearance.

In other embodiments, one or each of the coatings 140, 240 produces an optical interference phenomenon. One or each of the coatings 140, 240 can optionally have a different refractive index than the decorative object 10. Thus, optical interference can be produced. This can impart an aesthetically pleasing dichroic effect in the coated decorative object.

As noted above, one or each of the coatings 140, 240 can optionally comprise a second film layer deposited over an optional high absorption film layer. The second layer can comprise any of a variety of transparent, translucent, or opaque materials. In some (though, by no means all) embodiments of this nature, each of the coatings 140, 240 has an optical thickness of less than about one quarter of a wavelength (optionally a design wavelength, such as 550 nm) of visible radiation.

Examples includes metals, metal oxides, nitrides, sulfides, and transparent carbon. Titanium, aluminum, boron, carbon, zirconium, hafnium, niobium, vanadium, tungsten, chromium, and zinc are representative useful metals. Particularly preferred are titanium and titanium oxides, and, zirconium and zirconium oxides. Such materials can be amorphous or crystalline and can be composed of materials generally thought to be opaque, but when in very thin films are at least translucent. In certain embodiments, one or each coating 140, 240 has a second layer comprising a mechanically and chemically durable material, such as a film comprising titanium (titanium dioxide, titanium nitride, etc.), and/or silicon (silicon dioxide, silicon nitride, etc.), and/or carbon (diamond, diamond-like-carbon, etc.). In some (though, not all) such embodiments, the film comprising durable material is an exposed outermost film.

As noted above, certain embodiments provide a gemstone 10 having a pavilion 17, and the coatings 140, 240 are only applied to the pavilion. Faceted gems are usually set in jewelry with the pavilion protected by a setting. In many cases, the setting protects the pavilion from mechanical abrasion, which can occur when the gemstone is worn as an ornament. Coating the pavilion selectively is also advantageous in that it typically results in the viewing angle being limited by the setting to those angles viewable through the top of the stone, resulting in a particularly natural appearance of the stone since the effect of the coatings is viewed through the stone. When the top of the gemstone is uncoated, the "luster" or light reflected off the outer surface of the stone remains the same as the original stone since the reflection characteristics of the top of the stone are unchanged. While this feature is especially desirable for certain applications, it is not required unless it is specified for a particular embodiment.

The invention also provides method embodiments wherein a gemstone 10 is coated so as to color enhance the gemstone. In one group of embodiments, the method comprises applying a first coating 140 to a first area 14 of the gemstone 10 and applying a second coating 240 to a second area 24 of the gemstone. Here, the first and second coatings are of different composition. Preferably, the first coating 140 is adapted to impart a first color if applied alone to the gemstone, and the second coating 240 is adapted to impart a second color if applied to the gemstone alone (i.e., instead of in combination with the first coating). In some embodiments of the present group, the first 14 and second 24 areas of the gemstone 10 are maintained in an unmasked condition during the application of the first coating, and the first and second areas of the gemstone are also maintained in an unmasked condition during the application of the second coating. While this is not required in all embodiments, the related method embodiments offer advantages in terms of not having to mask and unmask the gemstone during production.

In one subgroup of embodiments, the method involves sequential area film deposition. In these embodiments, the application of the first coating 140 is completed prior to the application of the second coating 240. These embodiments may, for example, involve using a single precision spraying nozzle 370. In other embodiments, the method involves simultaneously applying the first 140 and second 240 coatings respectively to the first 14 and second 24 areas of the gemstone 10. These embodiments may, for example, involve using a plurality of (i.e., two or more) precision spraying nozzles.

In preferred embodiments, the gemstone 10 has a pavilion 17 and the noted first 14 and second 24 areas of the gemstone are both areas of the pavilion. Conjointly, in some embodiments, during the application of the first 140 and second 240 coatings an entirety of the pavilion 17 is maintained in an unmasked condition.

The gemstone 10 will commonly (though, not in all cases) have a table 12 and a pavilion 17. In some related embodiments, the application of the first 140 and second 240 coatings involves directing coating precursors toward the pavilion 17 in trajectories selected in combination with the orientation of the gemstone 10 such that the noted first 14 and second 24 areas of the gemstone are located primarily on opposite sides of a plane P1 that is at least generally perpendicular to the table 12 of the gemstone. This can be the case for a gemstone that is round, rectangular, etc.

The application of the first 140 and second 240 coatings can optionally involve spraying coating precursors from a nozzle 370 while moving the gemstone 10 relative to the nozzle. For example, the application of the first 140 and second 240 coatings can involve spraying coating precursors from a nozzle 370 (which is optionally held in a static position) while moving the gemstone 10 along a path lying in a plane P4. Such a nozzle can optionally be disposed on a frame 315 (and/or it can be moveable along an axis P5 that is at least generally perpendicular to plane P4). In some cases, this path is an orbital path such that the gemstone is moved in a revolving manner during the application of the first 140 and second 240 coatings. The gemstone, for example, can be removably secured to a substrate holder 500 that is rotated during the application of the first and second coatings. The substrate holder 500 in some embodiments of this nature comprises a body 510 that is at least generally cylindrical and that has a central axis CA about which the body 510 is rotated during the application of the first and second coatings. Optionally, the gemstone 10 can have a table 12 and a pavilion 17, and the table can be removably secured to an outer surface 520 of the body 510 such that the pavilion of the gemstone faces generally away from the body 510. The table 12 of each gemstone 10, for example, can be removably secured to the outer surface 520 of the substrate holder 500 by virtue of a glue, adhesive, or the like 88.

In certain embodiments, the application of the first 140 and second 240 coatings involves directing coating precursors toward the gemstone 10 while the stone is in an environment at ambient atmospheric pressure. Such deposition can optionally be carried out by spraying coating precursors onto the gemstone 10 while the stone and the nozzle 370 are both in an ambient environment. Additionally or alternatively, the gemstone and the sprayed precursors can be maintained at room temperature during deposition.

In general, the coatings can be applied using various deposition techniques. Exemplary techniques include spray coating, dip coating, sputtering, chemical vapor deposition (optionally plasma enhanced), evaporation, arc deposition, sol-gel application, thermal pyrolysis, and lacquering.

The application of the first 140 and second 240 coatings can optionally involve coating the gemstone 10 while the gemstone is maintained at a low temperature. In some embodiments of this nature, the deposition technique employs a low temperature so that the gemstone is not affected other than by having its surface coated. For purposes of this application, low temperatures are defined as those not substantially affecting the chemical structure of the gemstone, such as by melting, decomposing, chemically activating it, diffusing into it, etc. Generally, such a low temperature will be less than about 200 degrees Celsius. Thus, in some embodiments, the substrate 10 is maintained at a temperature of less than about 200 degrees Celsius (optionally at room temperature) during coating deposition. For example, representative low temperature vapor-coating techniques include:

(1) Sputtering applies energy from a plasma (e.g., argon) to a cathodic target material so as to eject energetic ions, atoms, and/or molecules, a portion of which then land upon and coat a nearby substrate. The ejected material may be produced by positive ions striking the cathodic target to eject the target material. Radio-frequency or direct current glow discharges also directly produce reactive ions, atoms, and/or molecules for coating a substrate. In the present invention, the substrate may be a gemstone and its pavilion can be coated by ions, atoms, and/or molecules sputtered from the bombarded target material. This method is generally employed at subatmospheric pressures and preferably at a near vacuum. For reactive sputtering, oxygen or other reactive gas (e.g., nitrogen) is added to an inert gas to react with the sputtered target material. When applying plural coats of material on the substrate, the same low temperature coating technique may be applied with a different coating material or by a different coating technique. In the situation of reactive sputtering, a different target and/or a different reaction gas can optionally be used without moving the substrate being coated. One or each of the coatings 140, 240 can also be deposited by co-sputtering (e.g., reactively) two targets of different material by selecting the respective target materials according to the material desired for the deposited film.

(2) Chemical vapor deposition (CVD) and physical vapor deposition (PVD) involve the passage of an active or reactive gas in an inert carrier gas across the surface of the decorative object being coated. The reaction gas then decomposes or is caused to react with components in the gas or the substrate to coat the substrate.

(3) Arc Source deposition is the use of direct current to ionize coating materials for coating a substrate. At lower currents, a glow discharge is produced and also may be used. The arc may be directly applied by making the substrate a workpiece anode. Alternatively, a plasma jet of excited gases may be applied to the surface of the substrate or gemstone to coat it. For such a coating method, the atmosphere is carefully controlled and usually involves subatmospheric pressure. The gas injected around the arc to be converted into a plasma may be inert, neutral, oxidizing, or reducing, depending on the particular coating desired. In evaporation, two or more sources of particles are aimed at a heated substrate. In ultra-high vacuums, a molecular beam epitaxy apparatus may form a single crystal coating layer.

(4) Low pressure chemical vapor deposition (LPCVD) involves the placing of the substrate in a vacuum chamber along with the coating materials. The coating materials are heated, typically by being placed in a heated vessel in the vacuum chamber. Under low pressure, the chemical vapor is evaporated and deposited as film on the substrate.

In each of these vapor-coating techniques, the thickness of a given coating can be changed by modifying deposition conditions. For example, when a film is applied by sputtering, the duration, power, deposition atmosphere, and material being sputtered determine the thickness of the deposited film. When coating the substrate by sputtering, the treatment time will vary depending on the particular apparatus, but generally ranges from about 5 minutes to about 30 minutes. A particularly thin film can even be applied in a matter of seconds.

In certain embodiments, a gemstone 10 is provided with different color zones using a post-deposition technique such as a photolithographic method. Selective etching of a color layer, for example, can be done to define desired color zones. In one embodiment, multiple colors are patterned on the surface of a gemstone 10 by performing a photolithographic technique following by a selective etching technique. Laser ablation can also be used to define desired coating zones for those materials that can be vaporized. One further embodiment involves patterning multiple colors on a gemstone 10 by performing partial immersion dipping of the stone.

Figure 7:
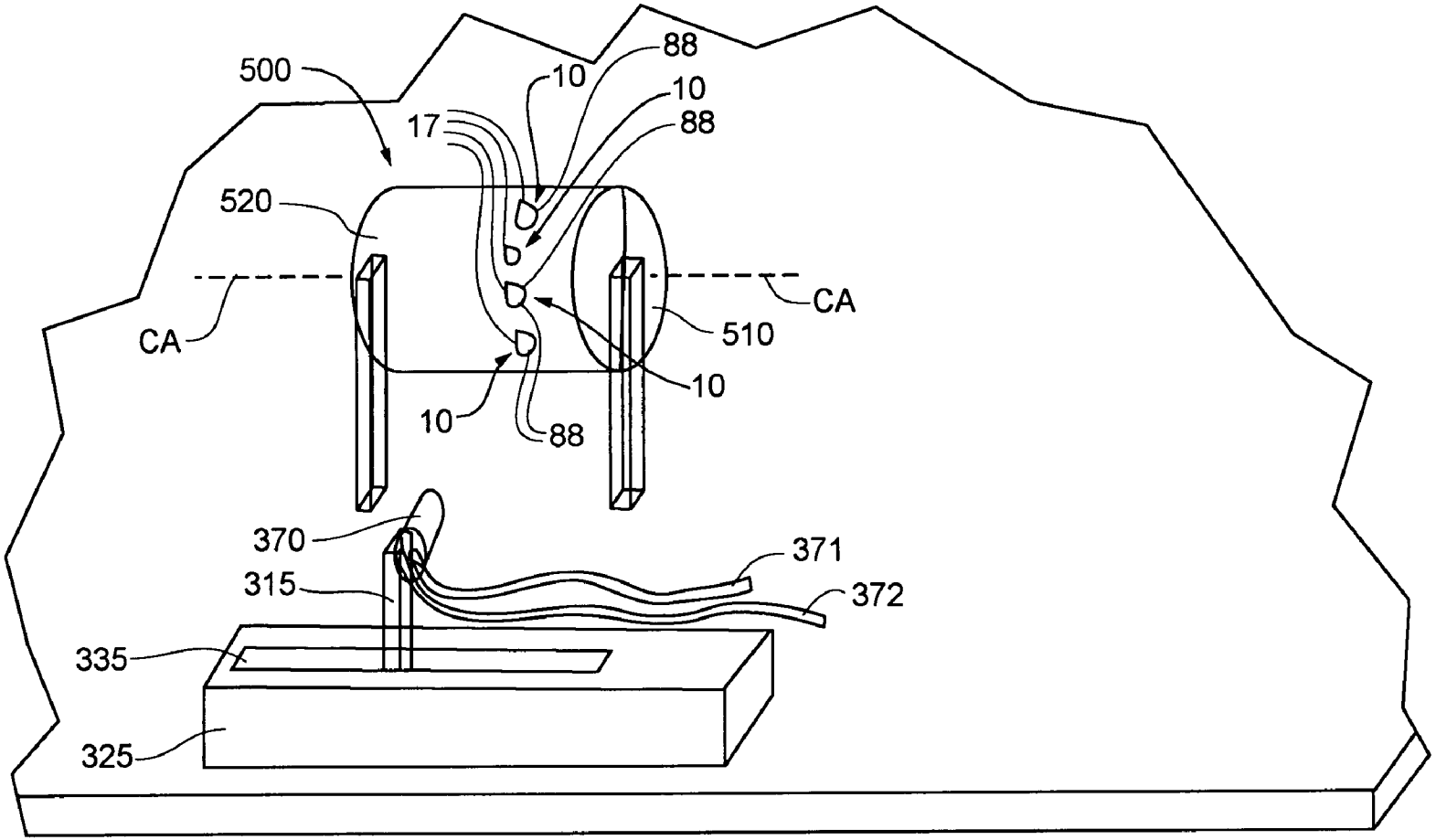
FIG. 7 is a schematic partially broken-away perspective view of a coating system in accordance with certain embodiments of the invention.
Figure 8:
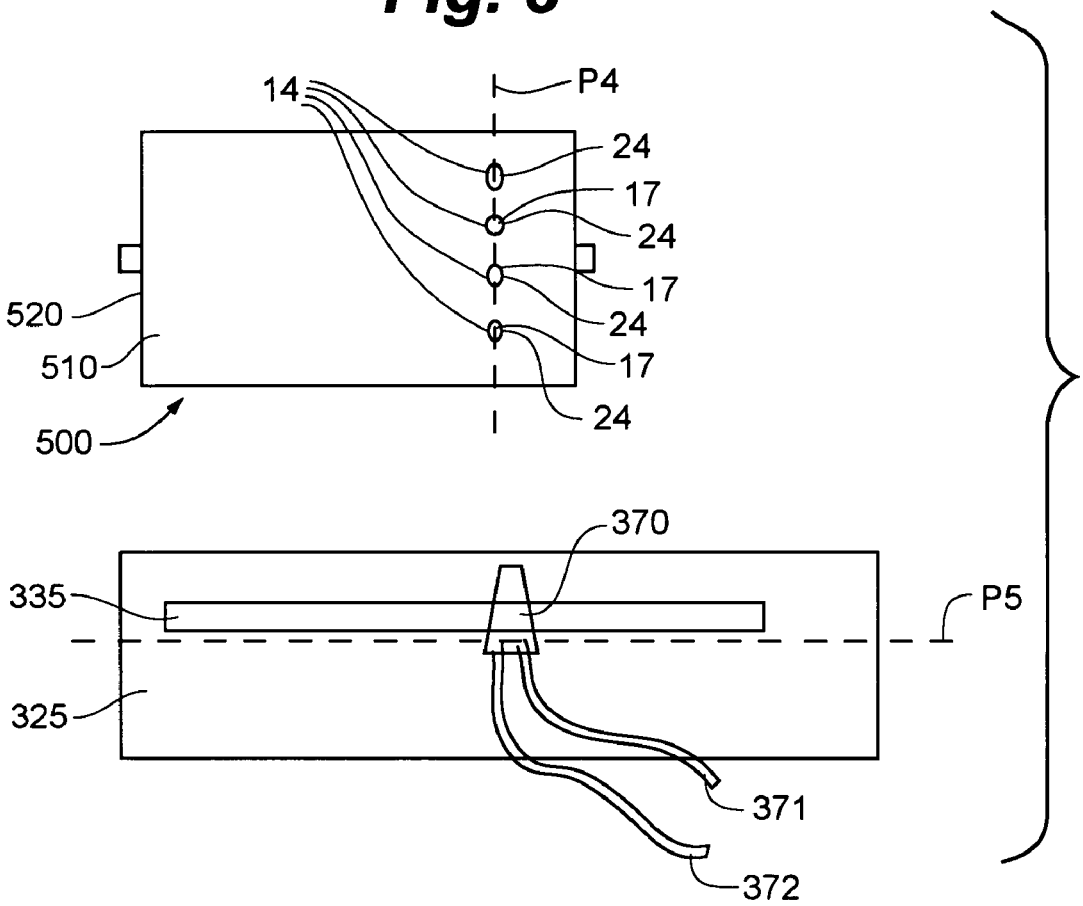
FIG. 8 is a schematic partially broken-away top view of a coating system in accordance with certain embodiments of the invention.

In one group of methods, there are provided a plurality of gemstones 10 each having a table 12 and a pavilion 17. In some methods of this nature, a substrate holder 500 is provided in combination with a precision spray nozzle 370. FIGS. 7 and 8 depict an exemplary coating system of this nature wherein the substrate holder 500 comprises a rotatable drum. Here, the drum has a cylindrical configuration with an exterior side (which defines an exterior surface 520). The exterior side of the drum can optionally be covered with aluminum foil or the like to which a plurality of gemstones have been removably attached. The table 12 of each stone 10, for example, can be removably secured to the foil using a glue, adhesive, or the like 88. On each piece of foil, one or more rows of gemstones can be attached. Each piece of foil can then be wrapped over, and secured to, the drum such that each row of stones extends endlessly about the drum's circumference (e.g., such that the pavilions 17 of the stones 10 are oriented generally away from the drum). The drum can then be rotated while the precision spray nozzle is used to spray a first coating over first sides of the pavilions of the gemstones. The nozzle can then be used to spray a second coating over second sides of the pavilions. Preferably, the resulting gemstones 10 have their pavilions 17 entirely or substantially entirely coated, while their tables 12 each define at least one uncoated area (and in some cases are entirely or substantially entirely uncoated). The foil carrying the coated gems can be removed from the drum, and the gems can then be removed from (e.g., peeled off) the foil and provided for use. In some embodiments, an optional post-deposition heat treatment is performed upon the coated gems.

Thus, certain embodiments the invention involve methods of heat treating coated gemstones and other coated decorative objects. In some embodiments of this nature, the method comprises: (1) providing a decorative object having two areas 14, 24 respectively bearing first and second thin film coatings 140, 240; and (2) heat treating the coated object to improve the color and/or other properties of the object. In these embodiments, the thin film coatings can be of a variety of different types. For example, the heat-treated coatings can be of the types described herein. However, the invention extends to performing the present methods of heat treating a coated decorative object regardless of the particular types of coatings that are on the decorative object.

The coated decorative object can be heat treated to enhance its properties (e.g., color, durability, etc.) using essentially any oven adapted to reach the desired heat-treatment temperature. Preferably, the oven is adapted to reach and maintain elevated temperatures of at least (e.g., greater than) about 200 degrees Celsius. More preferably, the oven is adapted to reach temperatures of between about 300 and about 600 degrees Celsius (e.g., at least about 400-450 degrees Celsius). In many cases, the oven is capable of reaching and maintaining higher elevated temperatures (e.g., at least up to about 700, 900, or 1150 degrees Celsius). Thus, it can be appreciated that the method may comprise positioning the coated object in an oven, and operating the oven so as to subject the coated object to a desired heat-treatment process.

The coated object can be subjected to a variety of heat-treatment processes. For example, the coated object can optionally be subjected to a heat-treatment process wherein the maximum temperature is less than that at which there occurs substantial diffusion of material from the coatings into the decorative object. Such a heat treatment would not cause coating material to diffuse substantially into the decorative object. Surprisingly, the described heat treatment can cause a great increase, or a great change, in the color of the coated object. For example, one or each of the coatings may not impart substantial color, or the desired color(s), in a gem or other decorative object prior to being heat treated, whereas following heat treatment the coated decorative object may exhibit a great increase, or a great change, in color. It is surmised that such a heat treatment can advantageously cause material in one or each of the coatings to crystallize (and/or to exhibit further crystal growth), thereby improving the intensity of the color(s) and/or causing one or more of the coatings to provide a particular hue.

In the present heat treatment embodiments, the coated object preferably is exposed to an elevated temperature of at least about 200 degrees Celsius, more preferably between about 300-600 degrees Celsius, and optimally between about 400-450 degrees Celsius. Preferably, the heat treatment (e.g., which typically begins with the coated object at room temperature) involves exposing the coated object to an elevated temperature, and raising this temperature to a desired maximum temperature (which is preferably at least about 200 degrees Celsius, more preferably between about 300-600 degrees Celsius, and optimally between about 400-450 degrees Celsius) in a period of between about 1-8 hours, and then decreasing this temperature (e.g., typically back down to room temperature) in a period of between about 1-8 hours. In one particular heat treatment method, there is provided a gem (e.g., topaz, quartz, etc.) bearing at least two different coatings of which at least one comprises titanium oxide and vanadium oxide (e.g., a 50-50 mixture). The thus coated gem is heat treated to (e.g., in an oven adapted to reach) a temperature of about 450 degrees Celsius in about 1-8 hours. The heat is then ramped back down to allow the coated gem to cool to room temperature over about 1-8 hours. Given the relatively slow heat-up time, the coated gem is heat treated without breakage. By contrast, an extremely fast heat-up time (e.g., heating a coated gem to such temperature using a torch, as may be done in about 30 seconds) is preferably avoided so as to prevent unacceptable gem breakage.

The present heat-treatment embodiments desirably involve a maximum temperature that does not exceed about 1150 degrees Celsius, preferably does not exceed about 900 degrees Celsius, perhaps more preferably does not exceed about 700 degrees Celsius, and perhaps optimally is between about 300 and about 600 degrees Celsius (e.g., 400 degrees Celsius or 450 degrees Celsius).

Some of the heat-treatment methods described above comprise coating at least two surfaces of the decorative object before heat treating the coated object. In these embodiments, the decorative object can be coated using a variety of coating methods. In certain embodiments of this nature, the method comprises spray coating and/or vapor coating the decorative object before heat treating the coated object. For example, the method may comprise spray coating and/or sputter coating the decorative object (e.g., such that each coating 140, 240 has a thickness of less than 50,000 Å, preferably less than 15,000 Å) before heat treating the coated object. As noted above, the decorative object can optionally be coated while maintained at a low temperature of less than about 200 degrees Celsius.

As noted above, the decorative object can optionally be a gemstone. Thus, the present heat-treatment methods can optionally begin by providing a gemstone having at least two surfaces respectively carrying first 140 and second 240 thin film coatings. The method can then comprise heating the thus coated gemstone to an elevated temperature of at least (e.g., greater than) about 200 degrees Celsius. Preferably, the coated stone is heated to a maximum temperature below that at which there occurs substantial diffusion of material from the coatings into the gemstone. In one such method, the coated gemstone is heated to a maximum temperature not exceeding about 1150 degrees Celsius, preferably not exceeding about 900 degrees Celsius, more preferably not exceeding about 700 degrees Celsius, and perhaps optimally being between about 300 and about 600 degrees Celsius (e.g., about 400 degrees Celsius or about 450 degrees Celsius). In some cases, the coated stone is exposed to temperatures exceeding these ranges, but not for so long as to cause substantial diffusion of coating material into the gemstone.

EXAMPLE 1

Faceted rectangular white topaz gemstones are cleaned with a 5% solution of Dawn dishwashing detergent in an ultrasonic cleaner for 5 minutes and rinsed with deionized water. The stones are secured upon a rotating drum (discussed above) in a line extending around the circumference of the drum, with the long dimension of the stones being parallel to the axis of the drum. Using the drum and a precision spray nozzle, a coating comprising Vanadium ($VO_2$), Bismuth ($BiO_x$), and Titanium ($TiO_2$) is applied to one side of the stone's pavilion, and a coating comprising Gold(Au), Cobalt ($CoO_x$), and Aluminum ($AlO_2$) is applied to the other side of the stone's pavilion. This yields a yellow and blue stone.

While preferred embodiments of the invention have been described, it should be understood that numerous changes, adaptations, and modifications can be made therein without departing from the spirit of the invention and the scope of the appended claims. All references mentioned in this application are incorporated by reference.

What is claimed is:

1. A gemstone having a table and a pavilion, wherein a first coating is on a first area of the pavilion and a second coating is on a second area of the pavilion, wherein the first and second coatings are of different composition, and wherein the table defines an uncoated surface, the pavilion having an overlap area characterized by a mixture of both the first and second coatings, and wherein on opposite sides of the overlap area there are areas respectively carrying substantially only the first coating and substantially only the second coating.

2. The gemstone of claim 1 wherein the table of the gemstone is entirely or substantially uncoated.

3. The gemstone of claim 1 wherein the first coating on said first area of the pavilion imparts a first color in a first region of the gemstone, and wherein the second coating on said second area of the pavilion imparts a second color in a second region of the gemstone.

4. The gemstone of claim 1 wherein the first coating on said first area of the pavilion imparts a dominant color in a first region of the gemstone, wherein the second coating on said second area of the pavilion imparts a non-dominant color in a second region of the gemstone, and wherein the gemstone further includes a third region that exhibits either the dominant color or a mixture of said dominant and non-dominant colors, said second region of the gemstone being located between said first and third regions of the gemstone.

5. The gemstone of claim 1 wherein said first and second areas of the gemstone are located primarily on opposite sides of a plane that is at least generally perpendicular to the table of the gemstone.

6. The gemstone of claim 1 wherein the gemstone has a cross section that is at least generally rectangular, said cross section having two long sides that are at least generally parallel to each other, and wherein said first and second areas of the pavilion are located primarily on opposite sides of a plane that is at least generally perpendicular to both of said two long sides.

7. The gemstone of claim 1 wherein the gemstone has a cross section that is at least generally rectangular, wherein said first and second areas of the pavilion are located primarily on opposite sides of a desired plane, and wherein said desired plane extends diagonally across such rectangular cross section of the gemstone.

8. The gemstone of claim 7 wherein the two coatings give the gemstone a single uniform body color that is different than a body color the gemstone would exhibit if it were coated with only one of the two coatings.

9. The gemstone of claim 1 wherein said first and second coatings are discrete coatings on the gemstone, such that the gemstone is at least substantially free of material diffused into the gemstone from either of said first and second coatings.

10. The gemstone of claim 1 wherein the gemstone is selected from the group consisting of topaz, quartz, beryl, and cubic zirconia.

11. The gemstone of claim 1 wherein one or each of said two coatings includes a colorant comprising a metal selected from the group consisting of chromium, cobalt, cerium, vanadium, praseodymium, manganese, iron, nickel, copper, ruthenium, rhodium, silver, gold, and platinum.

12. The gemstone of claim 1 wherein said two coatings impart in the gemstone a single uniform body color.

13. A gemstone having a table and a pavilion, wherein a first coating is on a first area of the pavilion and a second coating is on a second area of the pavilion, wherein the first and second coatings are of different composition, and wherein the table defines an uncoated surface, wherein the gemstone has a cross section that is at least generally rectangular, said cross section having two long sides that are at least generally parallel to each other, and wherein said first and second areas of the pavilion are located primarily on opposite sides of a plane that is at least generally perpendicular to both of said two long sides, wherein said cross section has two short sides, wherein the first coating on said first area of the pavilion imparts a dominant color in a first region of the gemstone, wherein the second coating on said second area of the pavilion imparts a non-dominant color in a second region of the gemstone, and wherein the gemstone further includes a third region that exhibits either the dominant color or a mixture of said dominant and non-dominant colors, said third region of the gemstone being adjacent to one of said two short sides of said cross section.

14. A gemstone having a table and a pavilion, wherein a first coating is on a first area of the pavilion and a second coating is on a second area of the pavilion, wherein the first and second coatings are of different composition, said first coating comprising a first material selected from the group consisting of platinum, copper, silver, gold, silicon, and bismuth, said second coating comprising a second material selected from the group consisting of chromium, niobium, tantalum, zirconium, titanium, and stainless steel.

15. The gemstone of claim 14 wherein the table of the gemstone defines an uncoated surface.

16. The gemstone of claim 15 wherein the table of the gemstone is entirely or substantially uncoated.

17. The gemstone of claim 14 wherein the first coating on said first area of the pavilion imparts a first color in a first region of the gemstone, and wherein the second coating on said second area of the pavilion imparts a second color in a second region of the gemstone.

18. The gemstone of claim 14 wherein the first coating on said first area of the pavilion imparts a dominant color in a first region of the gemstone, wherein the second coating on said second area of the pavilion imparts a non-dominant color in a second region of the gemstone, and wherein the gemstone further includes a third region that exhibits either the dominant color or a mixture of said dominant and non-dominant colors, said second region of the gemstone being located between said first and third regions of the gemstone.

19. The gemstone of claim 14 wherein the gemstone has a cross section that is at least generally rectangular, wherein said first and second areas of the pavilion are located primarily on opposite sides of a desired plane, and wherein said desired plane lies on an axis that extends diagonally across such rectangular cross section of the gemstone.

20. The gemstone of claim 14 wherein the pavilion has an overlap area characterized by a mixture of both the first and second coatings, and wherein on opposite sides of the overlap area there are areas respectively carrying substantially only the first coating and substantially only the second coating.

21. The gemstone of claim 14 wherein said first and second coatings are discrete coatings on the gemstone, such that the gemstone is at least substantially free of material diffused into the gemstone from either of said first and second coatings.

22. The gemstone of claim 14 wherein said first and second coatings each have a physical thickness of less than 15,000 angstroms.

23. The gemstone of claim 14 wherein said first material is selected from the group consisting of silicon and bismuth, said second material being selected from the group consisting of chromium, zirconium, and titanium.

24. The gemstone of claim 14 wherein the gemstone is selected from the group consisting of topaz, quartz, beryl, and cubic zirconia.

25. The gemstone of claim 14 wherein one or each of said two coatings includes a colorant comprising a metal selected from the group consisting of chromium, cobalt, cerium, vanadium, praseodymium, manganese, iron, nickel, copper, ruthenium, rhodium, silver, gold, and platinum.

26. The gemstone of claim 14 wherein said two coatings impart in the gemstone a single uniform body color.

* * * * *